United States Patent [19]

Ardito et al.

[11] Patent Number: 4,716,954

[45] Date of Patent: Jan. 5, 1988

[54] METHOD AND APPARATUS FOR SEQUENTIALLY CONTINUOUS CASTING DIFFERENT COMPOSITION GRADES OF STEEL

[75] Inventors: Victor P. Ardito, Lower Burrell; James R. Riedl, Freeport, both of Pa.

[73] Assignee: Allegheny Ludlum Corporation, Pittsburgh, Pa.

[21] Appl. No.: 922,579

[22] Filed: Oct. 24, 1986

[51] Int. Cl.[4] ..... B22D 11/04; B22D 11/16

[52] U.S. Cl. ..... 164/461; 164/419

[58] Field of Search ..... 164/461, 459, 419, 418

[56] References Cited

U.S. PATENT DOCUMENTS

| | | | |
|---|---|---|---|
| 4,250,945 | 2/1981 | Koshikawa et al. | 164/461 |
| 4,269,257 | 5/1981 | Ohzu et al. | 164/461 |
| 4,582,115 | 4/1986 | Corto et al. | 164/459 |

FOREIGN PATENT DOCUMENTS

| | | | |
|---|---|---|---|
| 114434 | 9/1979 | Japan | 164/459 |
| 53359 | 3/1983 | Japan | 164/459 |
| 138543 | 8/1983 | Japan | 164/459 |
| 33058 | 2/1984 | Japan | 164/459 |

*Primary Examiner*—Nicholas P. Godici
*Assistant Examiner*—Samuel M. Heinrich
*Attorney, Agent, or Firm*—Patrick J. Viccaro

[57] ABSTRACT

A method of and apparatus for sequentially continuously casting molten steels of different compositional grades is provided using mechanical separators of particular configuration. Such separators or chill units have a geometric shape selected from the group of spheroids, ellipsoids, and polyhedra and can be easily used to shorten the time between pouring the different compositional grades as well as for improving product yield for the cast slab.

14 Claims, 6 Drawing Figures

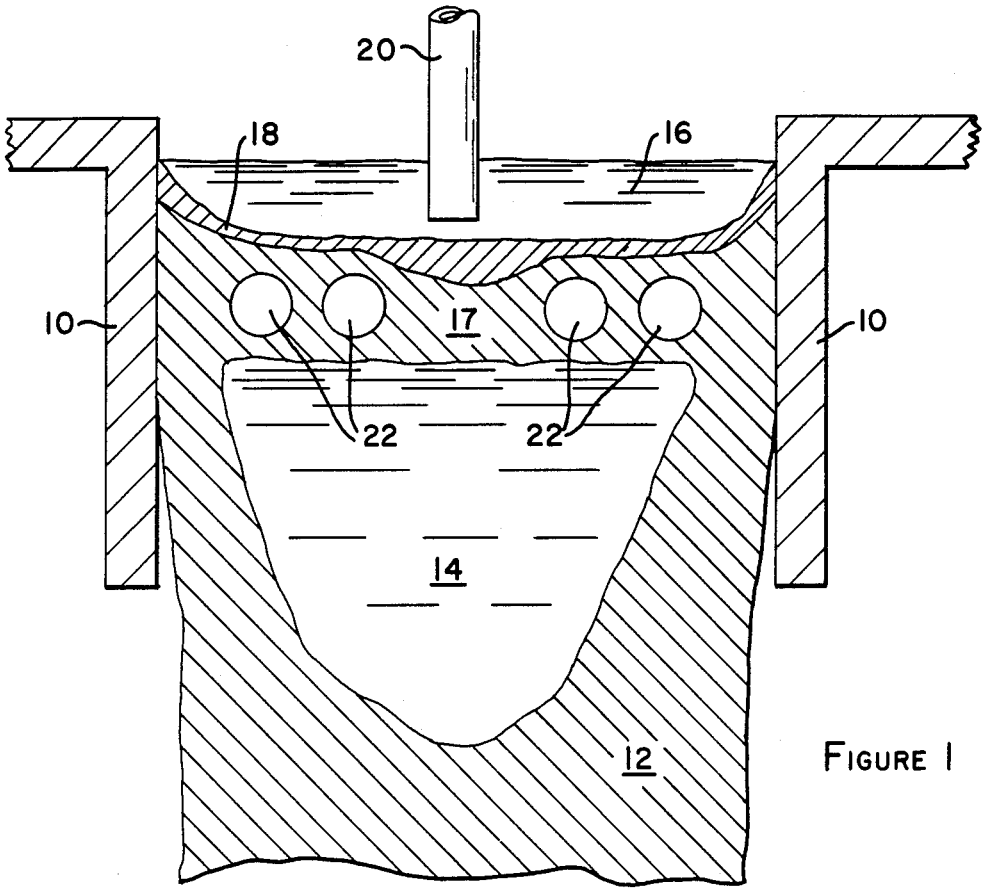
FIGURE 1
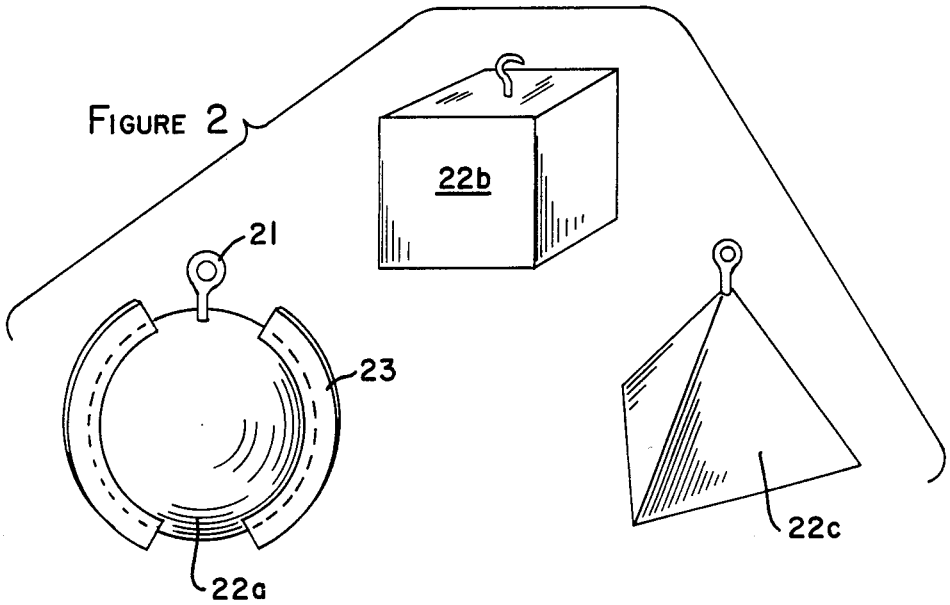

METHOD AND APPARATUS FOR SEQUENTIALLY CONTINUOUS CASTING DIFFERENT COMPOSITION GRADES OF STEEL

BACKGROUND OF THE INVENTION

This invention relates to a method of and apparatus for sequentially continuous casting different compositional grades of steel. Particularly, the invention relates to a method of using a mechanical separator having particular configurations to sequentially continuously cast different compositional grades of steel in shorter times and with better yields.

Since the advent of continuous casting, numerous attempts have been made to continuously cast in sequence steels having different compositions. Continuous casting of slabs is a preferred way of making and casting steel because of the lower production costs associated with such casting techniques. Further advantages associated with such lower production costs could be realized if steel alloys of different compositions could be sequentially cast with a minimal time delay between casting of different steels and with minimal associated problems.

Numerous attempts by others have been made to insert mechanical separators between different compositional grades of steel slabs during casting. Such separators have the purpose of solidifying the molten steel of a first slab of one composition in the mold, as well as facilitating connecting the first slab to a second slab of a different composition. For example, it is known to use single or multi-piece structures as separators which extend substantially across the length and width of the opening of the continuous casting mold. Such structures may take the form of partition plates or grids. For example, U.S. Pat. No. 4,250,945, issued Feb. 17, 1981, discloses immersing into the molten metal, a steel structure slightly smaller than the inner cross-sectional area of the mold. The particular structure disclosed is grid-like, having a plurality of vacant spaces of various shapes for allowing the molten steel to pass vertically through the structure. It is also known to use angle-shaped devices which are immersed with the angle edge downwardly into the molten metal (i.e., the angle opened upwardly) and which may extend partially or substantially across the continuous casting mold opening. Such prior art devices generally require special placement and orientation in order to function properly. While such mechanical separators have been somewhat successful, there are numerous problems associated with the method and apparatus set forth in the prior art which have not permitted sequence continuous casting of different compositional grades of steel to be a readily acceptable and efficient practice.

One problem associated with such prior art casting is that between a first slab of one steel composition and a second slab of a different composition, there is a transition zone in which there is mixing of the two steels. Such areas of the slab generally do not have adequate or desirable properties and must subsequently be cut out of the slabs during processing. Larger zones result in lower production yields. Such a problem is further aggravated when the two steels being cast have widely different compositions.

Another problem associated with sequence casting is the inability to maintain an adequate bond or connection between the two slabs of different compositions. Still another problem is that during the process of continuous casting the different compositional grades in sequence, there may result a "breakout" in the area in and about the transition zone due to insufficient solidification such that molten metal would break through the solidifying outer shell of the slab. When breakouts occur, then there are larger yield losses associated with casting production. Still another problem associated with sequence casting is the need to solidify the end of the first slab before or while commencing pouring and casting of the second slab of steel of a different composition and the time it takes to do so. In many prior art practices, it is necessary to move equipment, such as the nozzle or casting tundish out of the way, before the mechanical separators can be inserted into place and thereafter moving the nozzle or tundish back into place before casting the steel having a different composition. Such practices are inefficient and result in further production costs.

What is needed is a method and apparatus for sequentially continuously casting steels of different compositional grades which overcome the problems of the prior art. Sequence casting should minimize the area of mixing of the steels of different compositional grades so as to improve the yield. The method and apparatus should provide for a relatively easy way of sequentially casting so that the mechanical separator may be easily immersed into the molten steel without the problems associated with the orientation of the separator, or the movement of related casting equipment. And still further, it is desirable that a method and apparatus provide for minimal stoppage during casting while yet maintaining the integrity of the slabs sequentially continuously cast with different compositional grades.

SUMMARY OF THE INVENTION

A method of and apparatus for sequentially continuous casting molten steels of different compositional grades is provided. The method includes stopping the pouring of a first grade of molten steel into a continuous casting mold, immersing a plurality of discrete chill units into the first grade of molten steel to about the same depth, with the units having a geometric solid shape selected from the group of spheroids, ellipsoids, and polyhedra. The method then includes allowing the molten metal to solidify around said chill units and adjacent the interior walls of the mold to form a solidifying layer of steel and thereafter pouring a second grade of molten steel into the mold after the chill units are frozen into place in the solidifying metal and drawing from the mold a slab of solidifying steel of the first grade and then of the second grade.

The apparatus includes a continuous casting chill mold, a plurality of discrete chill units having a geometric solid shape selected from the group of spheroids, ellipsoids, and polyhedra, and means for lowering and immersing the plurality of chill units into a first grade of molten steel to about the same depth of immersion, by the means located above the mold.

BRIEF DESCRIPTION OF THE DRAWINGS

FIG. 1 is a schematic longitudinal section of a continuous casting mold showing sequential continuous casting of two different compositional grades in accordance with the present invention.

FIG. 2 illustrates various embodiments of an apparatus of the present invention.

DETAILED DESCRIPTION OF THE PREFERRED EMBODIMENTS

Figure 3A:
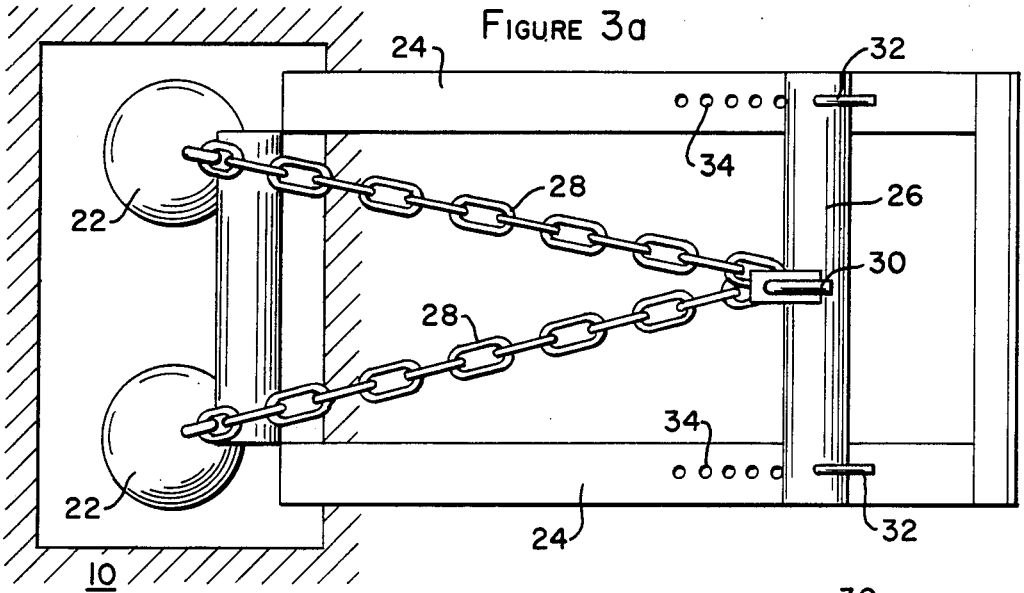
FIG. 3A is a top view illustrating one embodiment of a launching mechanism for the present invention.

FIG. 1 generally illustrates a continous casting mold 10 having a slab 12 having a first compositional grade being withdrawn from the bottom thereof while molten metal 16 of a second compositional grade is provided through nozzle or tundish 20. Chill units 22 are shown located in a solidifying portion 17 extending across the width of the casting mold opening which separates the steels of different compositions through a transitional or mixed zone 18 of solidifying metal. The central portion of slab 12 contains molten metal 14 of a first compositional grade not yet solidified.

Chill units 22 are mechanical separators of the present invention having shapes which are important to the ability to sequentially cast continuously different compositional grades of steel. Preferably a plurality of discrete chill units 22 would be immersed in the molten metal to facilitate solidifying a layer of metal substantially across the cross-sectional opening of the casting mold.

Chill units 22 have a unique shape which is essential to the present invention. The units have a regular geometric solid shape selected from the group of spheroids, ellipsoids, and polyhedra. A polyhedron is a solid shape bounded by planar polygons and may be tetrahedrons, cubes, octahedrons, and dodecahedrons. One shape or a combination of shapes may be used together for sequence casting different steel grades. The advantage of such shapes is that they are usable in substantially any orientation in order to provide substantially the same cooling effect to solidify a layer of molten metal to bridge the casting mold opening. FIG. 2 illustrates a chill unit **22*a* in the shape of a sphere, unit 22*b* in the shape of a hexahedron or cube, and unit 22*c* in the shape of a tetrahedron. In order to facilitate placement of units 22 into the molten metal, they may include a holding member 21 for attachment to a means for launching or immersing into the molten metal. Furthermore, units 22 may include other means for further enhancing the cooling effect of the chill units. As shown in FIG. 2, chill unit 22*a* includes projections 23**, which may take the shape of fins or protrusions for enhancing the cooling effect.

Preferably, chill units 22 are of substantially solid construction having no cavities or minimally-sized cavities within the units. Units which are hollow, i.e., having cavities therein, may provide sufficient cooling for purposes of this invention. Such hollow units, however, must have adequate mass and wall thickness so as to eliminate or minimize melting through the walls of the units in order to provide sufficient chill or cooling effect for solidifying molten metal layer 17 in the casting mold.

Chill units 22 may be made of various materials including cast iron or steel. Some criteria for choosing the proper material are the melting point of the material and the rate it cools the molten metal for solidification. The material chosen for chill units 22 should not readily melt when placed in the molten steel being cast and should extract heat sufficiently rapidly to solidify the molten steel.

Although the size of the chill units 22 is not critical to the present invention, the appropriate size must be chosen depending upon the size of the opening of the continuous casting mold in order to facilitate solidification in a timely and sufficient manner in order to sequentially continuously cast different compositional grades of steel. For example, for casting slabs of nominally 50 inches wide by 8 inches thick, the chill units may range in sizes to be about 3 inches and preferably between $\frac{3}{4}$to $1\frac{1}{2}$ inches less than the mold dimension corresponding to the slab thickness. Such chill units may range in size at the largest dimension from about 4 to 5 inches, for example. In other words, the chill units are immersed to within 3 inches of the long walls of the mold and preferably, within $\frac{3}{4}$ to$\frac{1}{2}$ inches.

The weight of the chill units 22 may range from 10 to 25 pounds. Although the weight is not critical to the present invention, the chill units should be of sufficient weight in order to be immersed into the molten steel. In that regard, the weight of the chill units should be greater than the weight of the volume of molten metal displaced when the chill units are immersed in the molten metal.

Figure 3B:
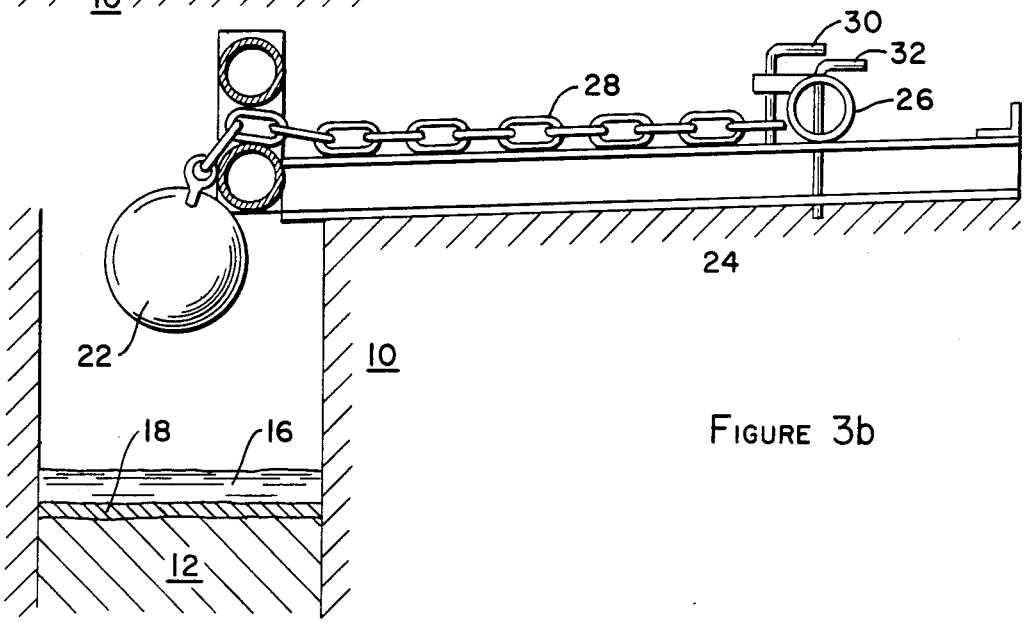
FIG. 3B is an elevation view illustrating the embodiment of FIG. 3A.

FIGS. 3A and 3B illustrate an embodiment of a mechanism for launching a plurality of chill units 22 for immersion into the molten metal in continuous casting mold 10.

Particularly, FIG. 3A is a top view of a means for launching the chill units 22 and which is located above the mold 10 and along the long dimension of the mold opening. The launching mechanism may include a support structure 24 as well as a movable member 26 which is fastenable thereto and to which multiple chill units 22 are attached by a tether means 28, such as chains. As shown in FIG. 3A, steel chains 28 may be fastened to holding member 21 on chill units 22 at one end and attached to movable member 26 of the launching mechanism. Chains 28 may be detachably fastened to movable member 26 such as by a removable locking pin 30. Movable member 26 may be detachably fastened to structure 24 of the launching mechanism by removable locking pins 32. Though it may not be necessary, it is preferred that the tether means 28 be made of the same or similar materials as chill units 22.

Structure 24 may include a plurality of holes or openings 34 at spaced intervals such that the precise location of movable member 26 can be set through the use of locking pin 32. By the interaction of movable member 26 and structure 24 with the locking pins and holes 34, the precise height of chill units 22 above the molten metal or immersed to a certain depth within the molten metal in continuous casting mold 10 can be established.

Through the use of chain 28 and a removable locking pin 30, the chains 28 may also be dropped into the molten metal after solidification of the molten steel of the first compositional grade about chill units 22 and prior to or during pouring of molten metal of a second compositional grade into the mold to sequentially continously cast. The chains facilitate lowering and immersion into the mold without interference with related equipment about the continuous caster and facilitate the formation of a thicker solidified layer of metal to prevent mixing of the different steel grades.

Figure 4:
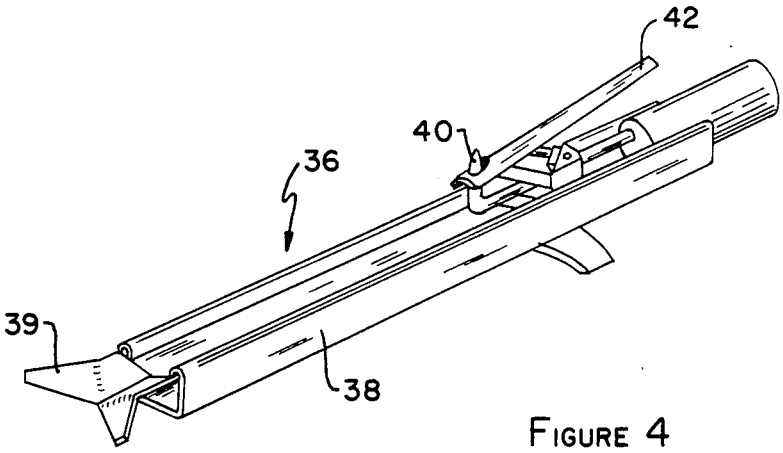
FIG. 4 illustrates another embodiment of a launching mechanism for the present invention.

FIG. 4 illustrates an alternative embodiment of a mechanism for releasing individual chill units 22 for immersion into the molten metal in continuous casting mold 10 from a location above the mold. Mechanism 36 may include a support structure 38, a longitudinal chain guide 39 therein, and a carriage member 40 movable thereon. Tether means 28, such as a chain, is detachably fastened to member 40 at one end and to holding member 21 on chill unit 22 at the other end. Structure 38 may include a release mechanism 42 for holding carriage member 40 with attached chain 28 in a ready position. By the interaction of release mechanism 42 and member 40, the chill units can be launched into the mold when member 40 (with chain 28 attached) is released and traverses chain guide 39 of structure 38 to the end. The chains 28 may then be dropped into the molten metal after substantial solidification of a layer 17.

Chill units 22 should be immersed to about the same depth in order to facilitate a relatively rapid solidification of a layer of metal bridging across the cross-sectional area of the mold opening. While the actual depth that the chill units are located in the casting mold is not critical, it is necessary that the units be immersed below the lower end of the submerged entry nozzle 20 in the casting mold 20. In that way the nozzle 20 is not frozen in the solidifying metal and does not have to be removed from the mold in order to sequence cast different grades. The chill units should be located deep enough in the casting mold to adequately and rapidly cool the solidifying layer 17. For example, in a casting mold nominally 51 inches wide and 8 inches thick, the chill units 22 may be immersed to about the same depth of about 14 to 22 inches, preferably, 16 to 18 inches.

In a process of sequentially continuous casting different compositional grades of steel in accordance with the present invention, the chill units 22 are located in a position above the normal level of molten level in the continuous casting mold 10. Such chill units may be held in position in any variety of ways. The launching mechanism disclosed in FIGS. 3A and 3B have shown to be useful. Usually a plurality of chill units 22 would be held in position for immersion on both sides of the submerged entry nozzle. The units would be properly spaced from each other and from the end wall and side walls of the mold 10. Units 22 would be in position while pouring the first grade of molten steel into the continuous casting mold 10. In order to commence sequential continuous casting, the method includes stopping the pouring of the first grade of molten steel and immediately thereafter immersing a plurality of discrete chill units 22 into the first grade of molten steel to about the same depth. Sufficient time is allowed for the molten metal to solidify around the chill units and solidify adjacent to the interior walls of the mold until solidified metal is formed across the cross-sectional area of the mold to form a layer of solidifying steel to cap off the compositional grade of the cast slab. Thereafter, a second grade of molten steel is poured into the mold after the chill units are frozen into place. Approximately simultaneously therewith the chains 28 would be dropped into the casting mold by the removal of drop pin 30 from movable member 26 of structure 24 and thereafter the casting machine would be again started to withdraw from the mold the solidifing steel of the first grade and thereafter the solidified slab of the second grade which is sequentially cast and bound thereto through transition zone 18.

It has been found that the time period between stopping the pouring of the first grade of molten steel and starting the pouring of the second grade of molten steel may range from 120 to 240 seconds and preferably from 120 to 180 seconds. During this time the metal freezes around the chill units and chains forming the solidified layer of metal, and little or no melting of the chill units and chains occurs.

In order to better understand the present invention, the following example is presented.

Types 304 and 201 steels were sequentially continuously cast having a nominal dimension of 8 inches by 51 inches wide in accordance with the present invention following the method steps described above. The first grade of molten steel was Type 304 and the second grade was Type 201. The total time period between stopping the pouring of Type 304 until starting the pouring of Type 201 was about 180 seconds. The transition zone 18 in the slab between the two compositional grades was about 100 inches long. During subsequent processing about 40 inches were removed from the slab before further processing.

Figure 5:
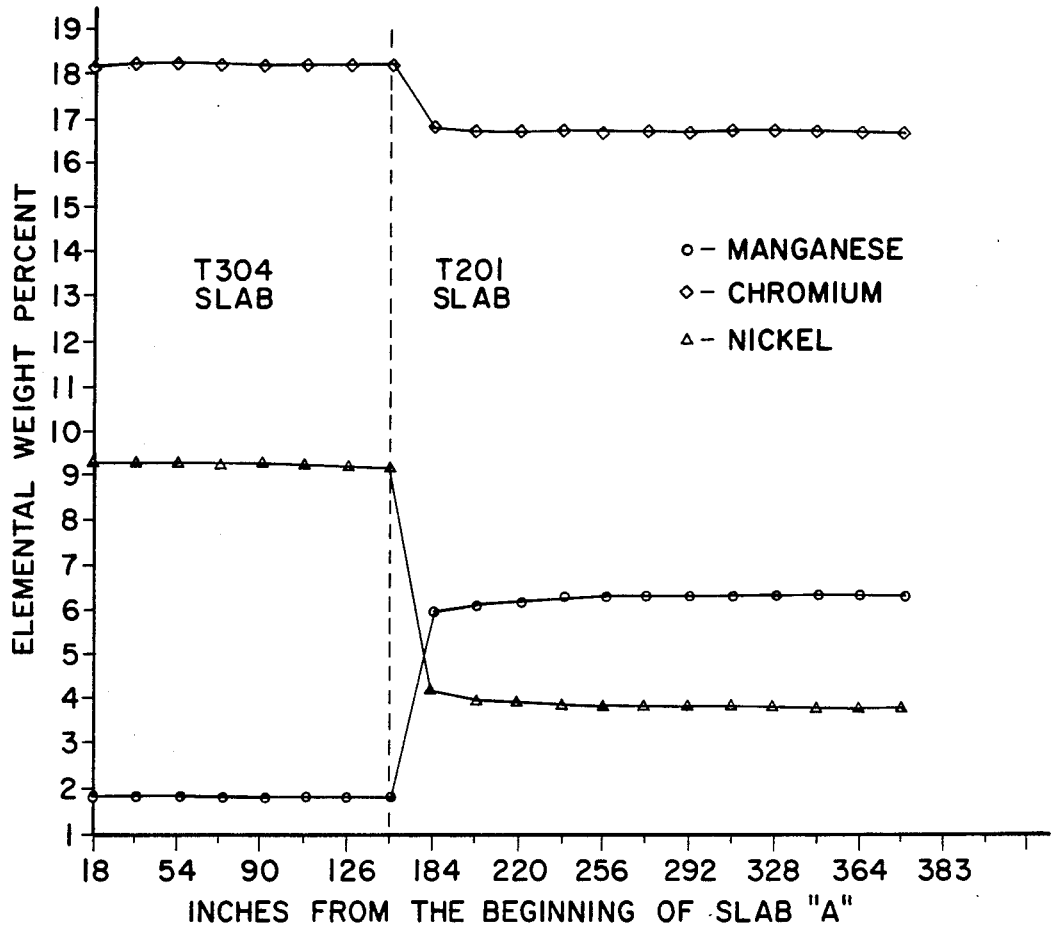
FIG. 5 is a graphical illustration comparing major compositional elements in two slabs sequentially continously cast in accordance with the present invention.

FIG. 5 graphically illustrates a comparison of some major elements of Type 304 and 201 as sequentially cast. Type 304 contains nominally 18% chromium, 9% nickel, and 2% manganese, and Type 201 contains nominally 17% chromium, 4% nickel, and 6% manganese. As shown in the graph, as the result of chemistry analysis of cast slabs, such widely differing compositions were easily sequentially cast with a minimum zone of about 40 inches being a mixed composition which had to be removed before further processing. Furthermore, the slabs were essentially crack-free in the transition zone and maintained good slab integrity during slab processing prior to removal.

As was an object of the present invention, a method and apparatus are provided for sequentially continuously casting different compositonal grades of steel in relatively shorter times and with minimal breakouts, cracks, and weaknesses in the transition area which may cause breakage during the straightener portion of the continuous casting apparatus. A further advantage of the present invention is that due to such short times during stoppage of the continuous casting, there is minimal heat distortion on the caster conveyor rolls attributable to the heat from the slab of the first compositional grade while waiting to sequentially pour the second compositional grade of steel. Furthermore, the present claimed invention has the advantage that it is not necessary to temporarily move any of the continuous casting equipment in order to get the mechanical separator into the molten metal.

Although preferred and alternative embodiments have been described, it will be apparent to one skilled in the art that changes can be made therein without departing from the scope of the invention.

What is claimed is:

1. A method of sequentially continuous casting molten steels of different composition grades, the method comprising:

(a) stopping the pouring of a first grade of molten steel into a continuous casting mold;

(b) immersing a plurality of discrete chill units into the first grade of molten steel below the surface thereof to about the same depth below a casting nozzle providing molten metal to the mold without moving the nozzle, said units having a geometric solid shape selected from the group of spheroids, ellipsoids, and polyhedra;

(c) allowing the molten metal to solidify around said chill units and adjacent the interior walls of the mold to form a solidifying layer of steel; and (d) pouring a second grade of molten steel into the mold after the chill units are frozen into place in the solidifying metal; and drawing from the mold solidifying steel of the first grade and then of the second grade.

2. The method of claim 1 wherein immersing the chill units includes immersion of said units on both sides of a casting nozzle which provides molten metal to the mold.

3. The method of claim 1 wherein the chill units are of substantially solid construction of regular geometric shapes.

4. The method of claim 1 wherein after the chill units are frozen into place in the solidifying metal of the first grade, then beginning to withdraw the solidifying steel from the mold before pouring the second grade of molten steel.

5. The method of claim 1 includes immersing the plurality of chill units into the first grade of molten steel at substantially the same time to about the same depth.

6. A method of sequentially continuous casting molten steels of different composition grades, the method comprising:

(a) stopping the pouring of a first grade of molten steel into a continuous casting mold;

(b) immersing a plurality of discrete and substantially solid chill units into the first grade of molten steel below the surface thereof at substantially the same time to about the same depth, said units having a geometric solid shape selected from the group of spheroids, ellipsoids, and polyhedra, with the same number of chill units immersed on both sides of and below a casting nozzle providing molten metal to the mold without moving the nozzle;

(c) allowing the molten metal to solidify around said chill units and adjacent the interior walls of the mold to form a solidifying layer of steel until the chill units are frozen in place in the solidifying metal of the first grade; and (d) begin withdrawing the solidifying metal from the mold and then pouring a second grade of molten steel into the mold and continue to withdraw from the mold solidifying steel of the first grade and then the second grade.

7. An apparatus for sequentially continuous casting molten steel slabs of different composition grades, the apparatus comprising;

(a) a continuous casting chill mold;

(b) a plurality of discrete chill units having a geometric solid shape selected from the group of spheroids, ellipsoids, and polyhedra; and (c) means for lowering and immersing the plurality of chill units into a first grade of molten steel below the surface thereof to about the same depth of immersion below a casting nozzle providing molten metal to the mold without moving the nozzle.

8. The apparatus of claim 7 wherein the chill units are made of material selected from the group of cast iron and steel.

9. The apparatus of claim 7 wherein the chill units are of substantially solid construction of regular geometric shapes.

10. The apparatus of claim 7 wherein the chill units include projections protruding from the surfaces thereof to further facilitate cooling the molten metal.

11. The apparatus of claim 7 wherein the means for lowering and immersing the chill units includes chains.

12. The apparatus of claim 7 wherein the means for lowering and immersing the chill units includes a mechanism for lowering and immersing a plurality of the units at substantially the same time.

13. The apparatus of claim 7 wherein the means for lowering and immersing the chill units is located along the width of the mold.

14. An apparatus for sequentially continuous casting molten steels of different composition grades, the apparatus comprising:

(a) a continuous casting mold and nozzle;

(b) a plurality of discrete chill units having a geometric solid shape selected from the group of spheroids, ellipsoids, and polyhedra; and (c) means for lowering and immersing the plurality of chill units into a first grade of molten steel at substantially the same time to about substantially the same depth of immersion on both sides of the casting nozzle; said means located above and along the width of the mold and, including steel chains.

* * * * *